US005353729A

United States Patent [19]

Goldbach et al.

[11] Patent Number: 5,353,729

[45] Date of Patent: Oct. 11, 1994

[54] APPARATUS AND METHOD FOR PERFORMING EXTERNAL SURFACE WORK ON SHIP HULLS

[75] Inventors: Richard A. Goldbach; William A. Wagner; Frank E. McConnell, all of Norfolk, Va.; Joseph H. Hoffman, Plano, Tex.

[73] Assignee: MMC Compliance Engineering, Inc., Norfolk, Va.

[21] Appl. No.: 99,434

[22] Filed: Jul. 30, 1993

[51] Int. Cl.[5] ..... B63B 59/00

[52] U.S. Cl. ..... 114/222; 451/88

[58] Field of Search ..... 114/222; 15/1.7, 53.1; 51/410, 424, 425, 426

[56] References Cited

U.S. PATENT DOCUMENTS 5,199,228 4/1993 Beausoleil ..... 51/410

5,211,125 5/1993 Garland ..... 114/222

OTHER PUBLICATIONS

"The Ferrous Wheel", Model No. 120P, sales brochure showing a device for picking up spent ferromagnetic abrasive grit.

*Primary Examiner*—Jesus D. Sotelo

*Attorney, Agent, or Firm*—Cushman Darby & Cushman

[57] ABSTRACT

Dry, particulate abrasive for use in abrasive blast cleaning of a ship hull is supplied to blasting pots from abrasive supply hopper assemblies lifted into place from a recycling station. Spent abrasive, with debris, is collected and placed on a conveyor belt extending parallel to the keel blocks, for conveying the collected material to the recycling station. There, the collected material is processed to remove undersized and foreign material from the reuseable abrasive grit. The latter is loaded into supply hopper assemblies, which are crane-lifted back into supplying relation with respective blasting pots. By preference, the abrasive blasting work takes place from elevatable, curtain-enclosed platforms supported on a drydock floor, the blasting pots are located on the drydock wing wall, the abrasive grit is ferromagnetic and recovered from the drydock floor partly with the aid of a magnetic abrasive pick-up unit, and the recycling station is located on a barge moored at an end of the drydock.

16 Claims, 7 Drawing Sheets

APPARATUS AND METHOD FOR PERFORMING EXTERNAL SURFACE WORK ON SHIP HULLS

BACKGROUND OF THE INVENTION

In general, the invention relates to providing an atmospherically controlled sealed enclosure which permits economical staging access to and coating of exposed areas of ships' hulls of varying configurations both afloat and in drydock during the abrasive blasting, spray painting and solvent evaporation phases of the coating process so as to be, so far as practically possible, in full compliance with requirements of the U.S. Clean Air Act and Clean Water Act.

The present invention relates to apparatus and a method for supplying abrasive blast media to workers working inside an enclosure, retrieving and recycling used abrasive, which improve upon the apparatus and methods which are disclosed in Garland et al., U.S. Pat. No. 5,211,125, issued May 18, 1993 and in the copending U.S. patent applications of Goldbach et al., application Ser. No. 07/975,520, filed Nov. 12, 1992 and application Ser. No. 08/27,802, filed Mar. 8, 1993. These are collectively referred to herein as the baseline apparatus and methods.

For disclosural purposes, the aforementioned U.S. patent and patent applications are incorporated herein by reference.

Ships' hulls are very large and are complexly contoured in both the vertical and longitudinal directions. The world's population of ships has a very significant number of different sizes and shapes.

Coating of the exteriors of ships requires using abrasive blasters for surface preparation and painters for application of paint. Both blasters and painters must be brought into close proximity to the portion of the hull they are working. Neither blasters nor painters can perform their work on much more than 75 square feet of hull surface without moving or being moved to another location.

In earlier times, worker movement from place to place around a ship's hull was accommodated by building staging around the ship.

Also, in earlier times, the coating of the exterior hull above the waterline was most often done with the ship afloat. However, enactment in the U.S. of the Clean Water Acts all but eliminated this practice since coating of this area of a ship afloat deposited significantly more spent abrasive and paint overspray in the water than did coating in a drydock.

More recently, required worker movement has been accomplished through the use of manlifts. A conventional manlift includes a staging basket mounted on an arm which has the capability of being hydraulically lifted, extended and rotated; this arm being mounted on a carriage powered by an internal combustion engine. The carriage has the capability of being moved from place to place on a horizontal surface.

Even more recently for abrasive blasting, efforts have been made to replace the worker in the manlift basket, with an enclosed shotblast head which has the capability of catching, processing and reusing the abrasive. However, this approach has had little acceptance because of the cost to purchase and operate the apparatus, plus operating difficulties with the devices actually available.

Since ships are very large vessels which operate on large bodies of water, their construction and repair including drydocking almost always takes place immediately adjacent to large bodies of water.

Pollution of these large bodies of water, including Great Lakes, rivers, seas, bays and oceans, has become of much greater concern to societies around the world because of the negative effect of this pollution on the vegetable and animal life which depend upon these bodies of water. This concern has grown as more of the public elects to use these bodies of water for recreation through swimming and boating as well as living adjacent to them in hotels, houses, apartments and condominiums.

Abrasive blasting of a ship's hull necessarily creates a significant quantity of particulate material, usually dust comprised, in part, of smaller particles of the abrasive medium as it breaks down upon being propelled pneumatically against the ship's hull and, in part, of small particles of the ship's paint and steel which is removed by the abrasive. While this dust is not currently officially considered to be hazardous, it is nevertheless noxious to the public and does contain toxins in apparently nonhazardous quantities.

Because a portion of this dust inevitably is blown over the adjacent body of water, small quantities of these toxins find their way into the water. Further, if the large percentage of the spent abrasive which lands on the drydock floor is not promptly cleaned up, trace amounts of the toxins leach out during rainstorms or from other sources of water used in ship repair and are deposited into the body of water from the drydock's drainage system. Toxic petroleum products, including fuels, lubricants and greases associated with manlift, forklift and compressor operations, can similarly be carried through the drydock drainage system into the adjacent body of water.

Recent regulations implementing the U.S. Clean Water Act impose more stringent restrictions on contaminants in storm water runoff. These regulations mandate that either contaminants be eliminated or drydock storm water runoff be collected and treated, a process not currently feasible because of the quantity of water involved.

Recent interpretations of regulations require spent abrasive to be disposed of in permitted landfills or recycled, significantly increasing disposal costs. Recent OSHA regulations impose more stringent regulations on exposure to spent mineral abrasive dust increasing the cost of blasting using mineral abrasive.

Typically, a ship has a large quantity of exterior mechanical equipment. This equipment, which is expensive to repair and purchase, is subject to severe damage if infiltrated by the dust from abrasive blasting, which is itself very abrasive. This mechanical equipment, which includes interior ventilation systems, must be temporarily covered with protective covering during abrasive blasting. This temporary covering inhibits operation of the interior ventilation systems when abrasive blasting is underway causing discomfort to ships' crew members living aboard as well as to workers inside the ship.

Virtually all the equipment currently used in abrasive blasting has mechanical components. This includes air compressors, manlifts, forklifts, dust collectors and drydock cranes. Since this equipment must operate during abrasive blasting, it cannot be protected. It, therefore, experiences very high maintenance cost, extensive out-of-service periods, and shortened operating lives.

Coatings on drydock horizontal surfaces experience short lives as they are abraded off by the combination of spent abrasive and vehicular and personnel movement, including that which accompanies shoveling and sweeping.

Workers, who are free to proceed with exterior ship construction and/or repair tasks which do not involve mechanical ship's components, are disrupted, made less efficient and exposed to respiratory and eye aggravation when abrasive blasting is proceeding concurrently. Workers and ship's personnel transiting through the abrasive dust cloud to and from the interior of the ship are similarly affected.

Most ships operate in a corrosive saltwater/spray environment. Therefore, the most popular marine paints are solvent-based vinyls and epoxies. Some marine paints contain zinc or copper. During the time that these paints are being applied, overspray is often blown into the adjacent body of water. This same overspray can coat itself on nearby boats, buildings, waterside cafes and cars, causing expensive damage and infuriating the public. Even the portion of the overspray which lands on the drydock floor can find its way back into the adjacent body of water as it attaches itself to dust or dirt particles on the floor of the drydock which are washed by water through the drydock's drainage system.

Non-waterbased paint solvents, common in marine coatings, release volatile organic compounds (VOCs) into the atmosphere during the time that they are evaporating, during the paint curing process. Regulatory authorities are becoming increasingly concerned that these VOCs are damaging the environment. While VOC emissions from marine paints may not be apparent to the public, they are a matter of growing regulatory oversight, and will ultimately have to be reduced. The only current way to dispose of these invisible VOCs is to contain the air into which they are released, and then process that air through a VOC incinerator.

Best management practices being currently utilized to minimize the amount of abrasive dust and paint overspray being blown beyond the drydock perimeter include placing a curtain over each end of the drydock, performing abrasive blasting downward only, using airless paint spray equipment, and ceasing operations when wind velocities become higher than a predetermined limit. However, these practices nevertheless permit a significant percentage of the airborne abrasive dust and paint overspray to blow outside of the perimeter of the drydock. In addition, these practices do nothing to reduce the many other negative affects of the ship coating process.

Recently, some shipyards have begun shrouding ships, from the weather deck down to the drydock structure, with very large strips of material. This material must be somewhat porous to keep it from shredding in the wind. However, the lives of these large strips of material are short because of damage from wind, handling, errant abrasive blasting and other hazards inherent to the heavy industrial environment prevalent in shipyards. Because of the basic cost of the shrouding material itself, its short life in the shipyard environment itself, the cost of installing, removing, handling and storing it, this approach is very expensive. While this approach contains even more airborne abrasive dust and paint overspray within the drydock perimeter than current generally accepted best management practices, some still escapes through the necessarily porous material and through the joints where the strips of material overlap. In addition, this approach does little to solve the many other negative effects of the ship-coating process and does nothing to reduce VOC emissions.

One other technology exists that reduces dust from sandblasting, that is the technology of vacuum blasting. However, this process is very slow and very costly from an equipment and manpower standpoint and does not address painting problems including overspray and VOC emissions.

With regard to approaches to resolving the many problems associated with the coating of ships, as expensive as the coating process is or may become, the major cost consideration is the speed with which a ship may be coated or recoated. This is because of the daily amortization and operation costs of the drydock required to lift the ship out of the water for recoating ($5,000 to $20,000 U.S. per day) and the ship itself, which is out of service during recoating ($10,000 to $100,000 U.S. per day). These costs demand that with whatever solutions are developed to solve the existing problems with abrasive blasting and coating of ships, elapsed time of the coating process be of the essence.

The aforementioned U.S. patent discloses a system for performing external surface work on a ship hull, in which a vertical tower is erected on a support surface beside a ship, e.g., on deck of a drydock in which the ship is berthed. A set of flexible confinement curtains externally surround the tower, but are open towards a vertical segment of the ship hull. The tower mounts a vertically movable trolley, to which a cantilever arm mechanism mounts a work platform. In use, workers and/or roboticly controlled devices operating from the platform use abrasive blasting (e.g., via compressed air-powered abrasive grit-spraying nozzles) and paint or other coating composition spray nozzles to work on the vertical segment of hull surface that is confined within the shroud provided by the curtains. A system of supply lines and recovery lines, which extend into and out of the confined space, supply air abrasive, paint and other needs, and collect fumes and other expended material for processing, reprocessing or disposal, all with the intent of minimizing contamination of the environment. Similarly, spent abrasive grit, with its burden of paint chips and scale fragments, is swept up for separation, reuse and disposal. As work on each vertical segment of the hull is completed, the tower is shifted to a successive location along the hull. Magnets mounted to edge portions of the curtains are used for removably fastening the front edge of the shroud to the ship hull around the whole of the perimeter of the respective vertical segment. During the course of the work on a segment, the work-applying nozzle is traversed horizontally while aimed at the hull, and after the particular act of work on each horizontal band of the segment has been completed, the trolley is raised or lowered on the tower, so that another band can be worked on. The cantilever arms, which mount the work platform to the trolley, are extended and retracted, as needed, for maintaining the desired proximity of the work-applying nozzle to the hull surface from one band to the next. Although the baseline apparatus and method as disclosed in this aforementioned U.S. patent contemplate that more than one tower may be in use at the same time for performing respective tasks on respective vertical segments of the same ship hull, this aforementioned U.S. patent does not disclose jointly shrouding plural ones of the towers.

However, this latter improvement is a main topic of the aforementioned copending U.S. patent application 07/975,520. The baseline apparatus and method as disclosed in that application discloses simultaneously working on adjoining segments of the same hull using a plurality of towers having respective adjustably cantilevered, elevatable work platforms, with the shroud curtains possibly providing interconnected confined spaces for all or some of the towers, with some side curtains subdividing the space in order to isolate the environments of various types of work from one another, as needed. That aforementioned U.S. patent application further discloses providing a support barge for carrying the various air compressors, paint supply tanks, abrasive material hoppers, so that all of these items of equipment need only to be connected to the various nozzles, etc., within the shrouded, confined space, rather than individually transferred to, from and from place to place around the hull. Other elaborations are disclosed, including possibly stationing the towers on a movable barge, so that the above-waterline part of a floating ship can be worked upon using the apparatus and method. In that connection, towers which can be laid down for transit on their support barge, then easily erected to vertical positions for use, are disclosed, as are ways and means for connecting the tower-support barge to the floating ship, and for using inflatable seals and also dams to seal the front edges of the shroud curtains to the hull, and bottom edges of the shroud to the support deck, despite possible relative movement of the ship and tower support barge, and for reducing runoff of spent abrasive, paint particles and removed scale from the tower support deck to the body of water around the floating ship, or ship in drydock, which is being worked on.

In the aforementioned copending U.S. patent application Ser. No. 08/27,802, further improvements are described, which facilitate automated abrasive blasting, abrasive blasting recovery and spray painting; reduce extent and costs associated with temporary hookup of equipment, hoses and ducting for ventilation and compressed air; provide a means of extending the reach of the worker platform; provide an improved means of rapidly and efficiently moving enclosure modules; provide an expanded number of modules without mechanisms to more rapidly accomplish coating.

In practicing the baseline apparatus and methods, as well as those of the present invention, it is a goal to provide sufficient freedom of motion to permit full worker and/or robotic access to all of the external surface of the ship hull that is to be worked on, and also to contain abrasive blast dust, spent abrasive, paint overspray and volatile organic compounds (VOCs), thereby significantly reducing the quantities of these materials which are released to contaminate the air, nearby bodies of water, ship's mechanical equipment, drydock cranes, abrasive blasting and painting support mechanical equipment, local housing, automobiles, nearby yachts and other floating vessels, and, in addition, significantly reduce the efforts necessary to collect, dispose of, recycle and incinerate waste abrasive and paint residue and significantly reduce the disruption of the concurrent shipboard repair work, all without increasing the drydock utilization times or ship out-of-service times.

Preferred practices of the baseline apparatus and methods made possible significant improvements in environmental compliance during ship-hull coating because of the following:

a. Use of internal combustion equipment is eliminated with its potential to pollute the water through fuel oil, lubricating oil and grease spills which run or wash off the drydock floor.
b. Abrasive dust is collected and processed without leaving the enclosure.
c. Paint overspray is filtered without leaving the enclosure.
d. VOCs are contained and incinerated without leaving the enclosure.
e. Storm water is prevented from running through spent abrasive and debris contaminated with paint.
f. Use of recyclable steel grit abrasive, instead of mineral abrasive, eliminates disposal of spent abrasive with its contained toxins.

Preferred practices of the baseline apparatus and methods also provide a significant opportunity for improvement in coating quality by preventing negative effects of weather by preventing rain or snow from impacting on hull areas during coating and by providing hotter dehumidified air during coating.

Preferred practices of the baseline apparatus and methods further provide a significant opportunity to shorten coating and drydock span times by:

a. Shortening or eliminating equipment mobilization, setup, tear down and demobilization time through use of the coating support barge.
b. Eliminating weather interruptions.
c. Accelerating paint curing by heating air in the enclosure.
d. Allowing most ship repair work to proceed during hull coating.
e. Reducing drydock clean-up time by confining contaminated or spent abrasive to within the enclosure.

Preferred practices of the baseline apparatus and methods facilitate reductions in the cost of the coating process not only for the reasons listed immediately above, but also because:

a. Rework from weather can be eliminated.
b. Transportation and crane handling of support equipment can be eliminated.
c. Abrasive contamination maintenance of manlifts, cranes, forklifts and compressors can be eliminated.
d. Wear and tear on portable hoses and ducting can be virtually eliminated.
e. Temporary covering of ship's mechanical equipment can be eliminated.
f. Purchase and disposal of mineral abrasive can be eliminated.

The present invention builds on the advantages provided by preferred practices of the baseline apparatus and methods, and, in preferred practices thereof, provides additional advantages.

The present invention provides certain improvements on the baseline apparatus and methods, that grew out of experiences with building and operating prototypes of such baseline apparatus and methods, and the making of plans for larger scale, commercial use of such apparatus and methods for performing external surface work on ship hulls.

SUMMARY OF THE INVENTION

Dry, particulate abrasive for use in abrasive blast cleaning of a ship hull is supplied to blasting pots from abrasive supply hopper assemblies lifted into place from a recycling station. Spent abrasive, with debris, is collected and placed on a conveyor belt extending parallel to the keel blocks, for conveying the collected material to the recycling station. There, the collected material is processed to remove undersized and foreign material from the reuseable abrasive grit. The latter is loaded into supply hopper assemblies, which are crane-lifted back into supplying relation with respective blasting pots. By preference, the abrasive blasting work takes place from elevatable, curtain-enclosed platforms supported on a drydock floor, the blasting pots are located on the drydock wing wall, the abrasive grit is ferromagnetic and recovered from the drydock floor partly with the aid of a magnetic abrasive pick-up unit, and the recycling station is located on a barge moored at an end of the drydock.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
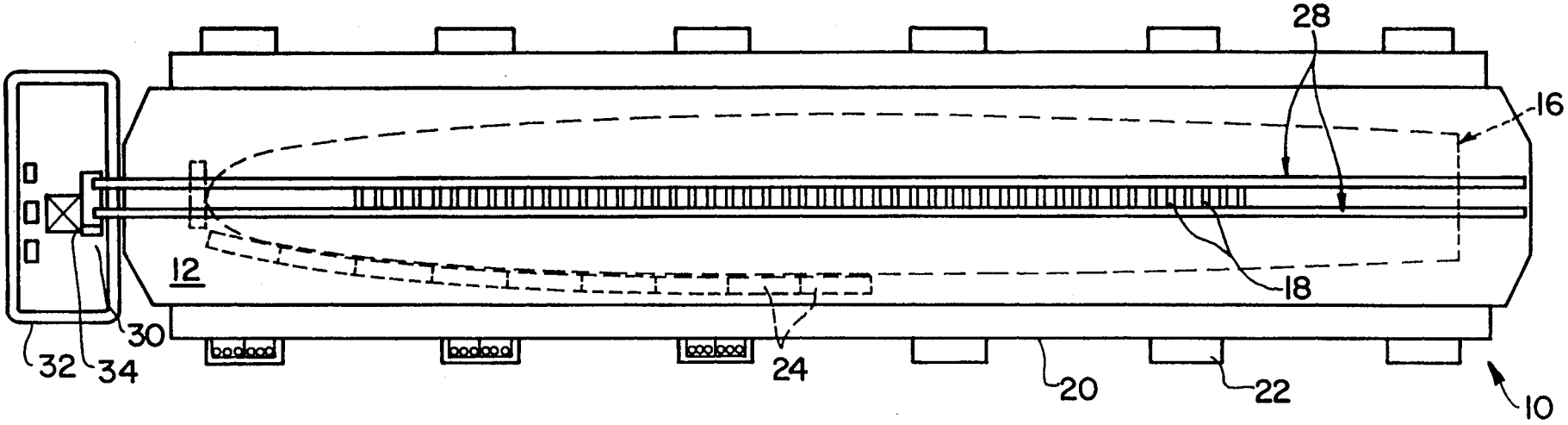
FIG. 1 is a schematic top plan view of a facility for practicing a preferred embodiment of the present invention using a floating drydock.

FIG. 1 shows schematically in top plan view a typical facility for carrying out a presently preferred embodiment of the present invention.

A floating drydock is shown at 10. It has a deck or floor 12, and opposite wing walls 14.

In phantom outline form in this Figure, a ship 16 is shown supported in the drydock 10, with its keel resting on a row of keel blocks 18 positioned in a series along the longitudinal centerline of the deck of the drydock.

Each wing wall of the drydock, near, but outboard of the usual catwalk extending along its upper end 20, has been provided with a plurality of blast pot support platforms 22.

The ship is shown having a set of curtain-enclosed, elevatable work platform supporting towers 24 stationed side by side in a series extending along a whole quadrant (in this instance, the port/forward quadrant) of the ship 16.

These towers, and the curtain structure, which encloses them against the external surface 26 of the ship hull for creating one shared enclosed work space for all of the towers, or two or more enclosed work spaces, each containing one or more of the towers, may be constructed, provided and used in the manner that is disclosed in much more detail in the aforementioned U.S. patent and/or copending U.S. patent applications. (A reiterative brief description will be provided below in relation to this and others of the drawings hereof.)

Some other features of the preferred embodiment, which are depicted in FIG. 1, include two abrasive material recovery conveyors 28 which extend along the length of the deck 12 and over one end, so as to have the ends of their carrying runs disposed over the deck 30 of an abrasive reclaiming barge 32, which provides the preferred location for an abrasive recycling station 34.

Details of the blast pot support platforms, blast pots (and abrasive supply hoppers and the lifting frame for the latter) are discussed below with reference to FIGS. 1 and 2.

Use of the towers and blasting equipment for cleaning the ship hull external surface is discussed below with reference to FIGS. 1 through 5.

Recovery at the drydock deck level, of the spent abrasive, and associated debris, is discussed below with reference to FIGS. 1 and 4 through 6.

Processing of the spent abrasive and associated debris to obtain dry abrasive grit stock for recycling via abrasive supply hoppers to the blasting pots up on the wing walls is discussed below with reference to FIGS. 1 through 8.

Although the blast pots 36 and abrasive supply hoppers 38 could be provided as individually movable, separate units, it is preferred that they be assembled as respective connected sets. In the instance depicted, blast pots 36 are assembled in sets of three, secured in respective three-dimensionally rectangular welded steel stacking frames 40 each arranged to be lifted, moved, lowered into position and left in place, by a standard lifting frame 42. The lifting frame is designed to disconnectably connect with connectors (not shown in detail) at the four upper corners of each stacking frame 40, and, in turn, to be supported on a wire rope sling 44 from a crane (not shown). The sling 44 includes operating cables (not shown in detail) for connecting and releasing the connectors on the lifting frame 42 from the corresponding connectors on a respective stacking frame 40. In general, the operating relation of the lifting and stacking frames, sling and crane may be similar and comparable to the relation of the structures that are conventionally used for manipulating ISO containers between ships, docks and truck trailers.

The same is true for the supply hoppers 38, which also are shown assembled in sets of three, secured in respective three-dimensionally rectangular welded steel stacking frames 46, arranged to be lifted, moved, lowered into position and left in place by the lifting frame 42. The stacking frames 46 correspond to the stacking frames 40, so that respective ones of the former can be stacked onto respective ones of the latter, as shown on the blast pot support platforms in FIGS. 1 through 3.

In the instance depicted, there are six platforms 22 equally spaced from one another on each wing wall 14, each stacking frame 36 carries three blast pots all arranged vertically and in one line that extends longitudinally of the drydock, and each stacking frame 46 carries three abrasive supply hoppers 38 all arranged vertically and in one line that extends longitudinally of the drydock. In actual practice, these numbers and spatial orientations could be varied.

The purpose of each abrasive supply hopper 38 is to act as a dispensing receptacle for dry abrasive particles, for supplying the respective underlying blast pot 36, by gravity feed, with abrasive grit. For that reason, each hopper 38 includes a top opening 48, through which it can be filled with abrasive grit, a cover 50 (which preferably slides into and out of place and, when in place, provides a weather-tight seal particularly against intrusion of rainwater), a peripherally complete set of sidewalls 52, and bottom walls 54 which slope towards a central outlet 56. Except when the hopper is in place in feeding relation over a respective blast pot 36, each hopper outlet 56 is closable by a shutter plate (not shown) for facilitating refilling and transfer of the abrasive supply hopper.

The purpose of each blast pot 36 is to receive a gravity-fed supply of dry abrasive grit particles from a respective abrasive supply hopper 38 having its open outlet disposed in feeding relation thereto, to entrain that supply of grit particles, on demand, into a stream of pressurized air flowing through an outlet hose 58, to a nozzle 60 for application of the abrasive grit to the hull surface 26. The blast pot 36 may be of known, conventional construction. Alternative abrasive delivery systems could be used, e.g., where grit is delivered for centrifugal propulsion off a spinning grit-propelling device, e.g., such as is available from The Wheelabrator Corporation, Newnan, Ga. 30263.

Figure 2:
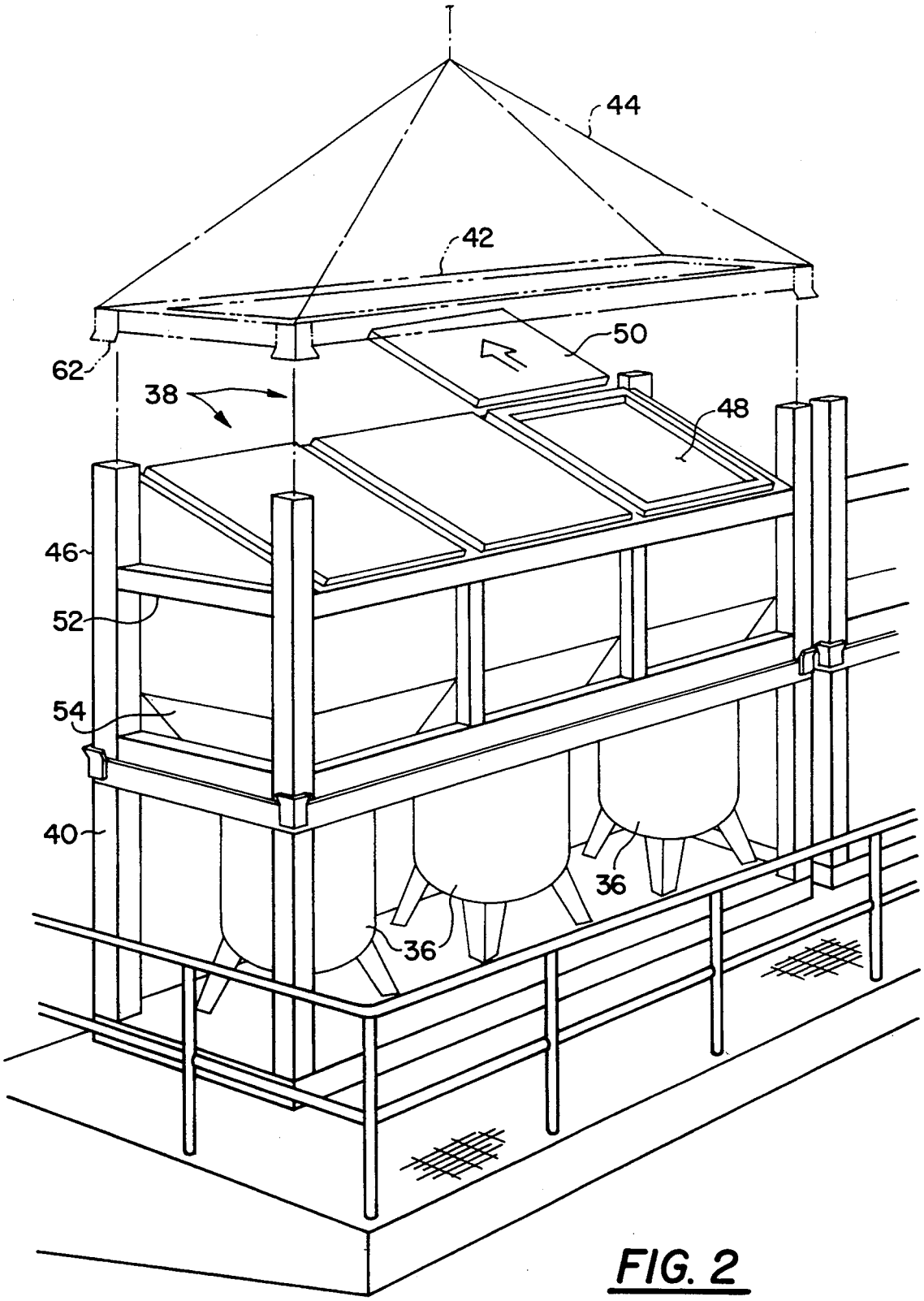
FIG. 2 is a fragmentary perspective view showing a set of abrasive supply hoppers transferred onto, or immediately prior to being transferred from support on a set of blasting pots located at an abrasive blasting grit supply station on a wing wall of the drydock.

The stacking frames 40 and 46 include corner guides and vertically interengageable features 62 to facilitate stacking in vertical registry, as best illustrated in FIG. 2.

In actually practicing the process, platforms 22 around the quadrant of the ship hull being cleaned are provided with a full complement of blasting pot sets, and respective sets of abrasive supply hoppers 38 full of dry abrasive grit are shuttled into place by crane from the recycling barge 32. As hoppers 38 become empty, the respective empty sets are shuttled by crane to the recycling barge 32. Outlets 56 are opened and closed as needed. When cleaning work on one quadrant is completed, the blast pots and fill abrasive hoppers can be shifted to the set of platforms 22 which flank the next quadrant of the ship that is to be cleaned.

Figure 3:
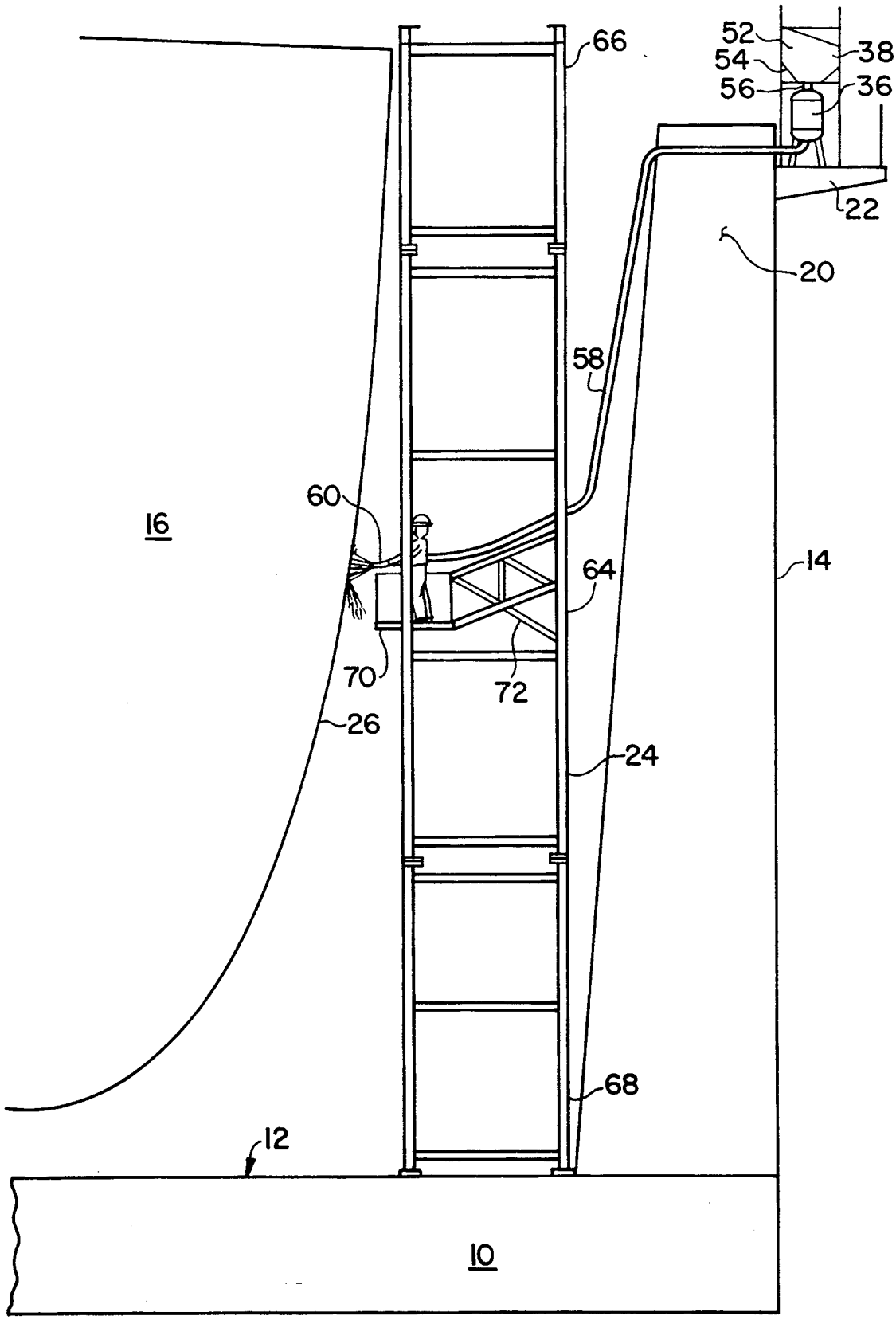
FIG. 3 is a fragmentary schematic side elevation view, looking longitudinally along the drydock, to see an operator on a platform applying abrasive to the exterior surface of the ship hull.

Referring particularly to FIGS. 1 and 3, the ship hull-cleaning process is preferably run in tandem with a hull paint process, quadrant by quadrant around the hull.

The preferred tower apparatus 24 includes a plurality of modular towers, including vertically stackable 64, 66, 68 base, middle and top modules made of steel framework such as is commonly used in scaffolding and staging. Each tower mounts a work platform 70 on cantilever arms 72 from an elevatable trolley (not shown), which runs on vertical tracks provided on the tower, and is vertically moved and positioned by a hoist (not shown) mounted on the top module 66. As the work platform is stationed at any particular level, the operator (human or robotic) progressively shifts the nozzle 60 from side to side while abrasive grit is being sprayed in compressed air released therefrom or otherwise propelled, so as to impact and thereby abrade scale, paint and other debris from the respective horizontal band of the respective vertical increment of the respective quadrant of the hull surface 26.

As the work platform is shifted in height by raising or lowering the trolley, the operator also can extend or retract the cantilever arms 72 in order to maintain a uniform working distance between the nozzle 60 and the work surface 26, despite the fact that the surface 26, while being generally vertical, slopes inward near the keel on most ships.

Although not shown in the drawings, in actual practice, a system of curtains, flexible and/or rigid, with seals, attachments, spreaders and other adjusting and accommodating devices are provided either for each tower, or (more preferably) around most or all of the towers in common. These extend around the sides, back and top of whatever they enclose, and have front edges plus a lower front lip which enclose against the surface 26 so as to provide for each tower, or for the respective towers in common an effective curtain-enclosed work space containing the towers, work platforms, operators and nozzles.

The tower modules 64–68 can be lifted, shifted and put in new locations using a sling and crane as has been described above in relation to the frames 40, 46. Those wishing to know more details of preferred practices are referred to the U.S. patent and copending applications identified in the Background section hereinabove.

As dry abrasive grit forcibly issues from the nozzle or other propelling device 60, it impacts the work surface 26, whereupon some of it fractures, some becomes more rounded, and scale, paint chips and other debris are removed with it thereby making a spend abrasive material which typically includes a high percentage of perfectly reuseable dry particulate abrasive grit. The mixed material is ejected or rebounds from the surface 26 and begins to fall, under the influence of gravity.

Figure 5:
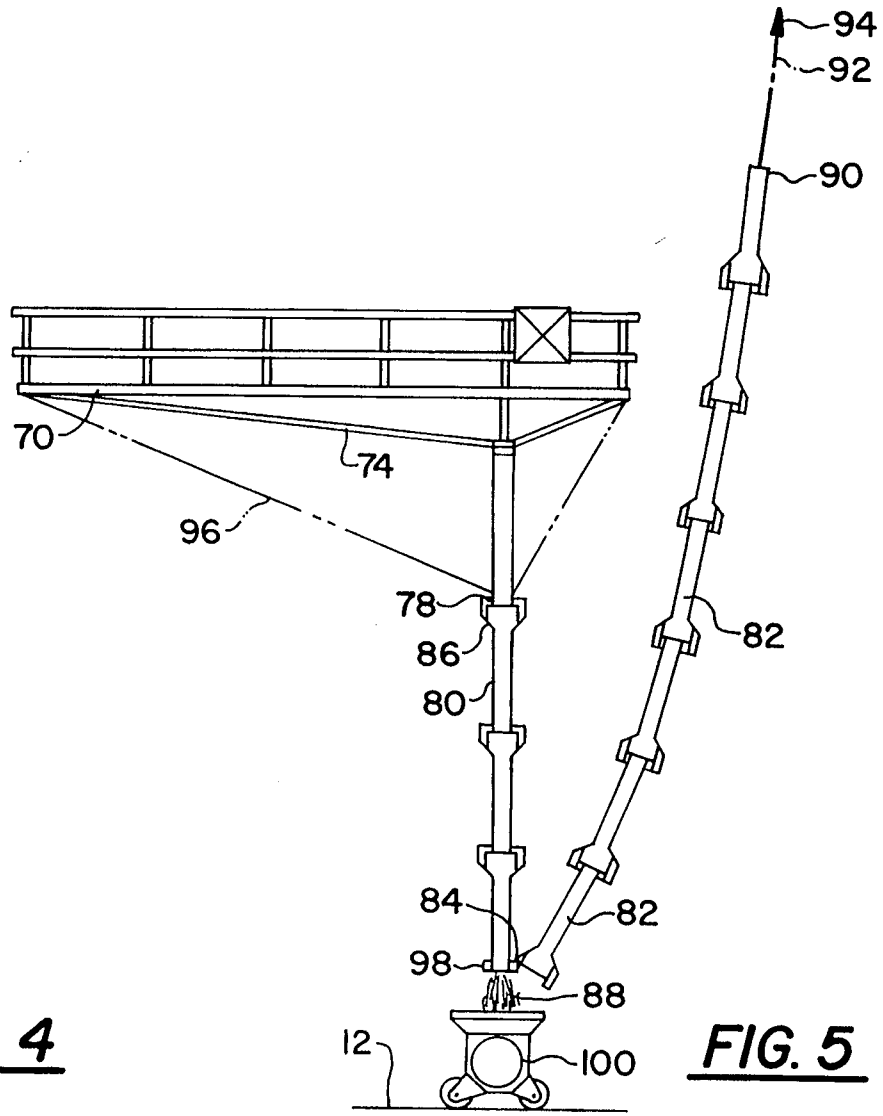
FIG. 5 is a fragmentary front elevation view of some of the features shown in FIG. 4.

By preference, a catch pan 74 is secured under each work platform 70. It is shaped and positioned to catch much of the ejected, rebounding and falling spent abrasive mixed material 76. The pan 74 preferably is funnel-shaped, so that captured material 76 gravitates towards an outlet 78 which feeds the inlet end of a chute 80. The chute 80 can be provided as a conventional multiple-section articulated construction chute of the type often used for directing debris from various heights, to a collection point. To that end, the sections 82 are hinged at 84 serially together from a corresponding location on the rim of each so as to form a substantially continuous conduit when aligned in a right-side-up orientation, but to form an outlet wherever rotated out of alignment. Accordingly, as seen in FIG. 5, the chute 80 has an inlet 86 effectively communicated with the outlet 78 of the catch pan 74, and an outlet near the drydock deck 12 at 88. The chute is hung from the catch pan 74 at the inlet end of the cute. The opposite end 90 of the chute 80 is hung by cabling 92, which extends out of sight to the upper right in FIG. 5 as indicated by the arrow 94 to attach to convenient elevated structure. A set of guy wires 96 are shown steadying the lower end of the first section of the chute relative to corners of the work platform. As the work platform 70 is raised and lowered on the respective tower 24, the part of the chute, which is effectively in use, automatically adjusts as the band 98 (and, thus, the chute outlet) propagates along the series of chute sections. (Because FIG. 4 is a view corresponding to looking toward the left from the right of FIG. 5, the chute sections, which show in FIG. 4, are the inverted ones that are not in use.)

Figure 4:
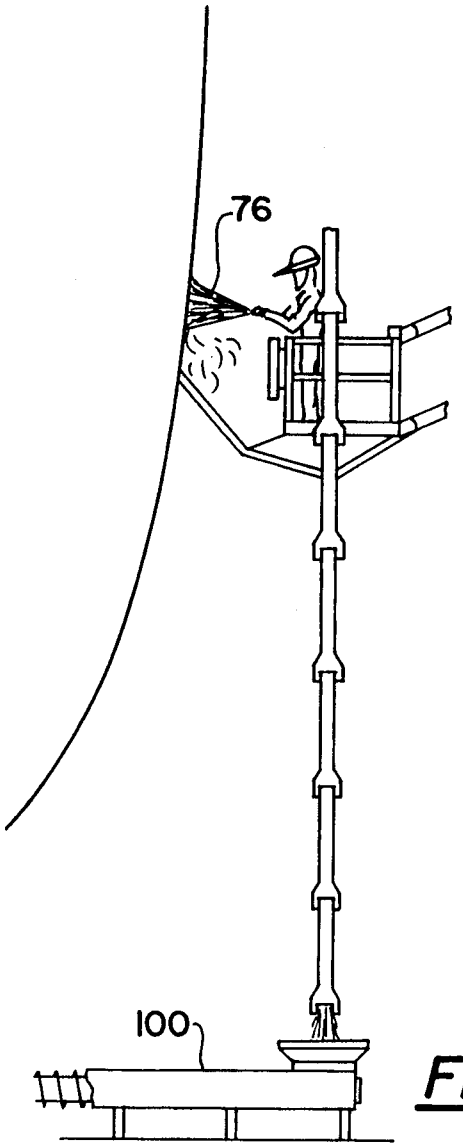
FIG. 4 is a similar fragmentary schematic elevation view which emphasizes other features.

Referring to FIGS. 4 and 5, the chutes 80 are shown having their outlets 88 arranged to direct spent abrasive mixed material which descends through the chutes, into the inlets of movable screw conveyors 100 supported (e.g., on wheels on the deck). The outlets of the screw conveyors 100 dump the collected spent abrasive mixed material into inlets through the cover 102 of a respective one of the abrasive material recovery conveyor, one of which is shown at 104 in FIG. 6. Each of the conveyors 28 is shown comprising an endless belt-type conveyor having an upper, horizontal carrying run 106 and a lower return run. Each conveyor 28 further includes a frame 108, belt guides 110, supports 111 for supporting the belt at an elevated location relative to the deck 12, drive, idler and tensioning rolls (not shown, but conventional) about which the conveyor belt is entrained for being driven and supported.

Figure 6:
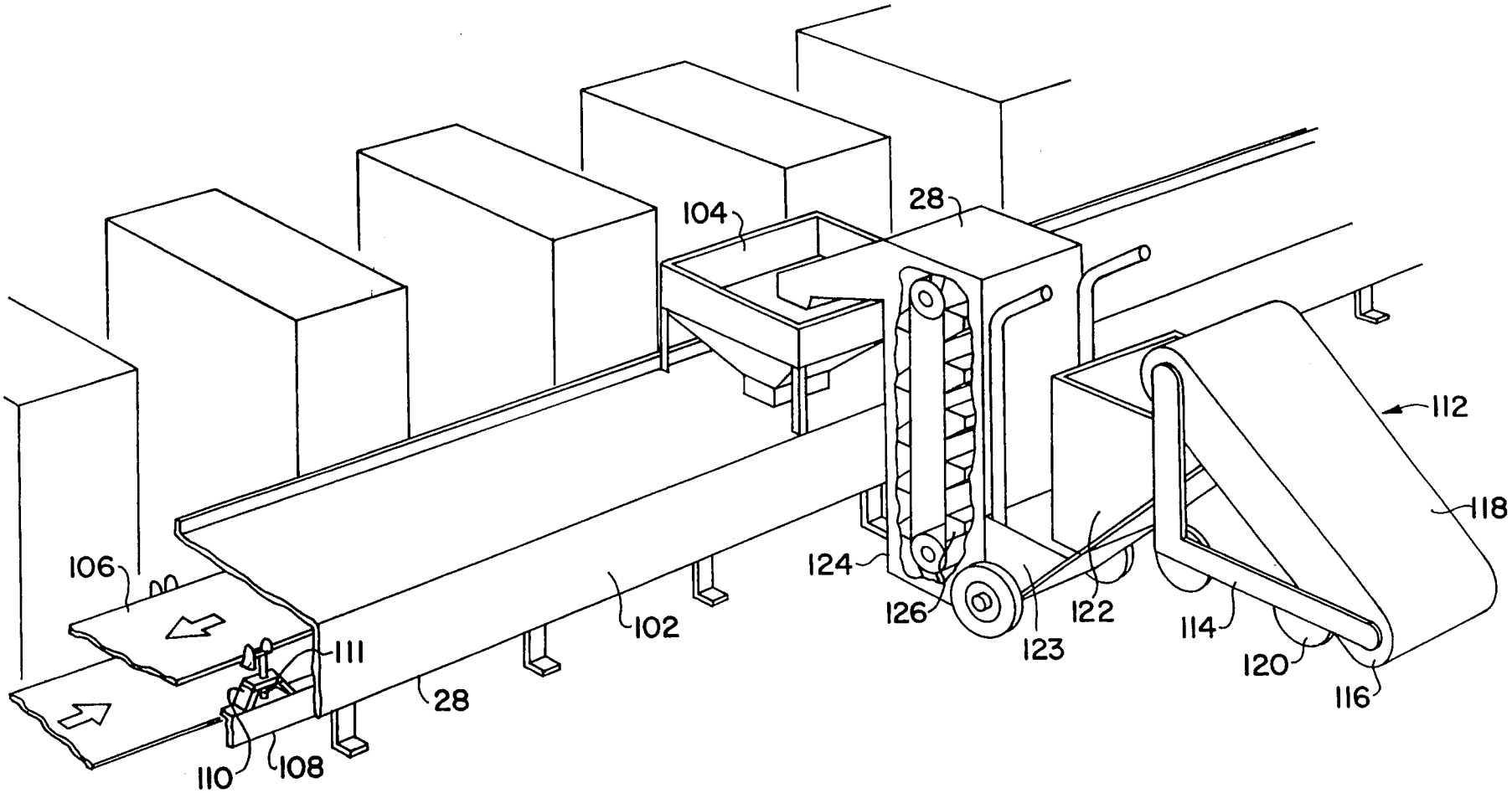
FIG. 6 is a fragmentary perspective view showing a spent abrasive collection station at the drydock floor.
Figure 7:
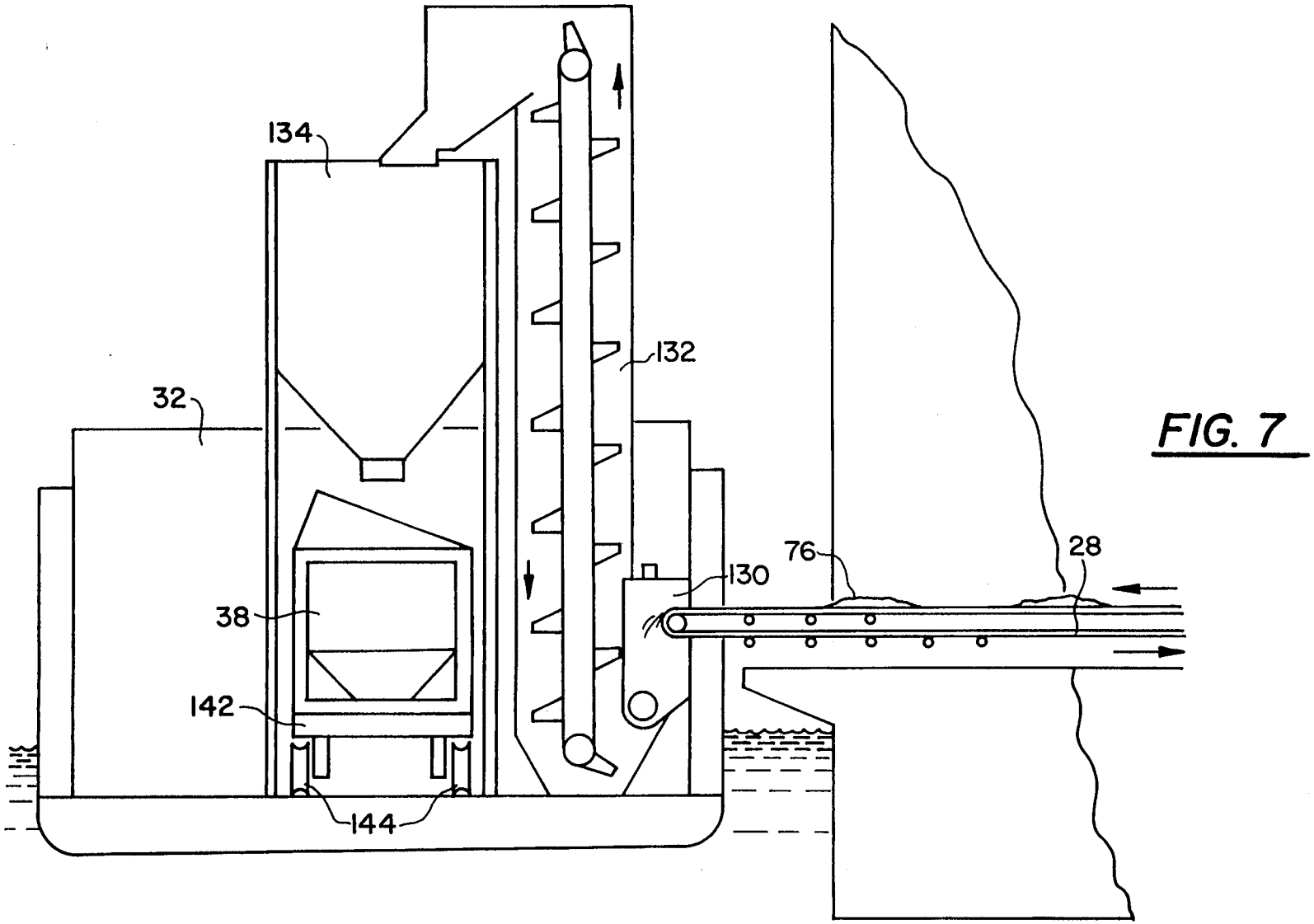
FIG. 7 is a fragmentary sectional view on line 7—7 of FIG. 1, showing transfer of the collected spent abrasive material to the abrasive grit recycling station aboard a support barge moved at an end of the drydock.
Figure 8:
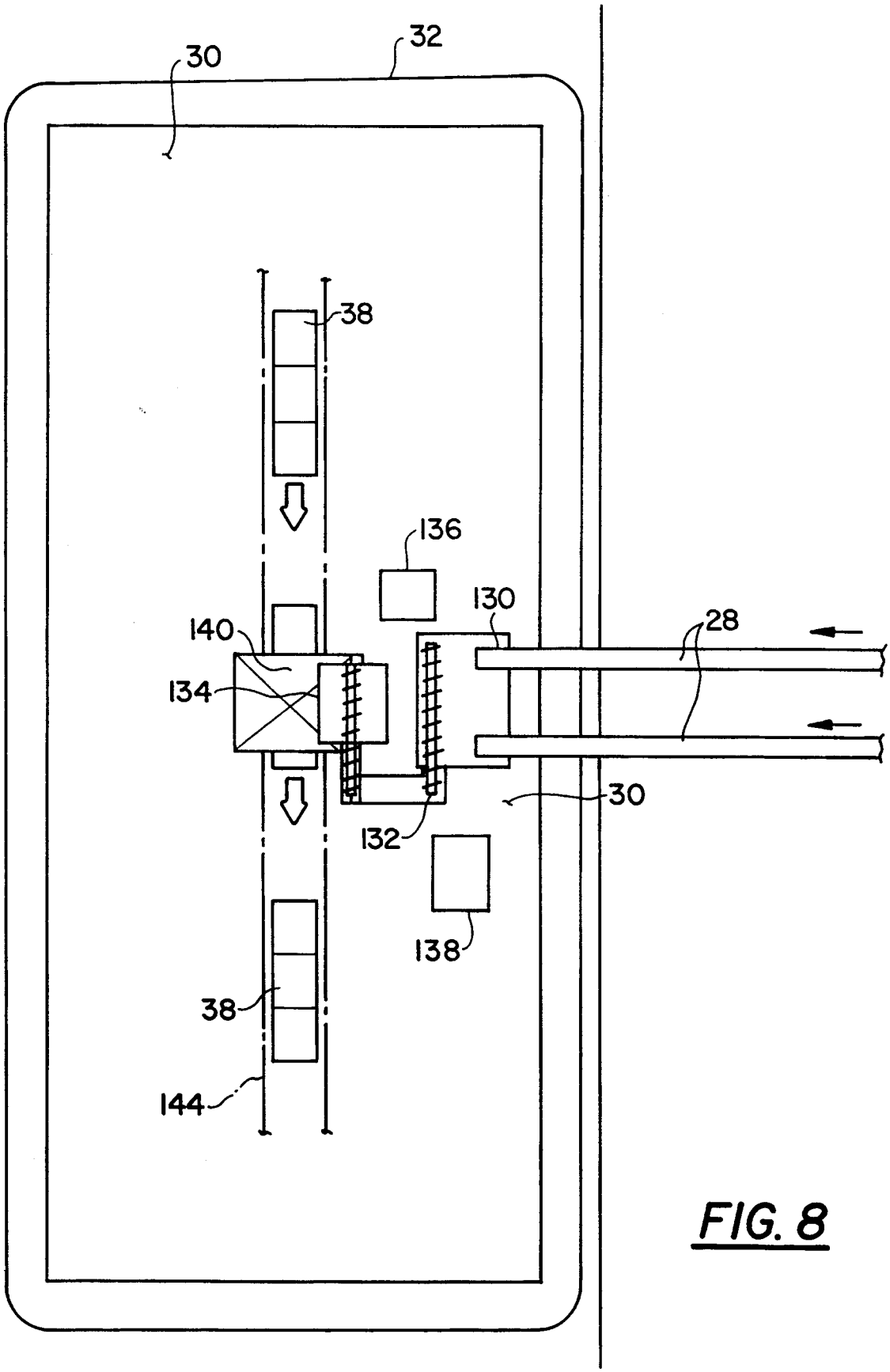
FIG. 8 is a fragmentary top plan view of the features depicted in FIG. 7, further details of the preferred abrasive grit recycling station being visible in this view.

In operation, each conveyor 28 runs in the direction indicated by the arrows shown at the left in FIG. 6. Accordingly, spent abrasive mixed material which, having been introduced through the inlets 104 lands on the carrying runs 106 to the abrasive recycling station 34 provided on the deck 30 of the abrasive recovery barge 32 (FIGS. 1, 7 and 8).

Not all of the spent abrasive mixed material, which rebounds from the work surface 26, is caught by the catch pan 74, descends through the chute 80 and is collected by a screw conveyor 100 and introduced through an inlet 104. Some misses the catch pan, or for other reasons, spills onto the deck 12.

In practicing preferred embodiments of the invention, that spilled spent abrasive mixed material is collected by other means and also introduced through an inlet 104 and sent on its way via the conveyor belt run 106, to the abrasive recovery station. That "other means" can be as simple as a push broom and dust pan (or its industrial equivalent), or more elaborate sweeping, vacuuming up and discharging devices, such as are conventionally used for cleaning factory floors. For use, especially in instances where (as is preferred) the abrasive grit used is ferromagnetic material, e.g., hard steel grit, the spilled material pick-up means preferably includes a magnetic abrasive pick-up unit 112. Although an average person may never have seen or heard of such a device, in fact, they are commercially available. The exemplary magnetic abrasive pick-up unit 112 includes a frame 114 mounting rollers 116 about which an endless belt 118 is entrained. The frame 114 is supported on the deck 12 on wheels 120. The upper carrying run of the conveyor belt 118 slopes upwards and a collecting hopper 122 is mounted on the frame 114 so that its upper inlet end is arranged to receive particulate material collected by the belt 118, as that material is separated from the belt 118 at the upper end of the carrying run of the belt. The belt 118 is made of magnetic material (or electromagnetized ferromagnetic material). As the device 112 is run around the deck, with the conveyor belt 118 advancing (due to powering of one of the rollers 116, or due to rotational motion transmitted by suitable transmission means from the wheels 120), particulate ferromagnetic constituents of the spilled spent abrasive mixed material adhere to the belt 118 at its lower end. These are carried up and removed, e.g., by a scraper and/or by periodic turning off of the electromagnetizing circuitry for the belt, so that the collected material dumps into the hopper 122.

Periodically, as the hopper becomes loaded with collected material, the unit 112 is run over to location shown in FIG. 6, at which the shutter-closed lower, outlet end of the hopper 122 is disposed over the upper, inlet end of an inlet 123 for a mobile abrasive-handling elevator 124. This transfer conveyor 124 is arranged to collect material dumped into its inlet 123 as the shutter on the outlet end of the hopper 122 is opened, elevate this material (e.g., using an endless conveyor belt having buckets 126). The buckets dump into an outlet 128 which, in turn, dumps through the inlet 104, onto the carrying run 106 of the conveyor 28.

On the abrasive recovery barge 32 (FIGS. 1, 7 and 8), the spent abrasive mixed material 76 is fed off the downstream ends of the carrying runs of the conveyors 28 into an accumulator bin 130.

Screw and bucket conveyors 132 forward the accumulated material 76 to a classifier 134. This device, which may include a cyclone separator, separates the stream of material 76 into oversize (trash), which is forwarded to trash baskets 136 undersize (dust), which is forwarded to a dust collector 138, and reusable abrasive grit, which is forwarded to a master hopper 140. Make-up (new) abrasive grit also can be added to the hopper 140 from time to time for replacing grit, which has broken-down in use and, therefore, has been separated out as undersize.

The deck 30 of the abrasive recycling barge 32 is provided with a rail track on which sets of abrasive supply hoppers 38 are arranged to roll on bogies 142.

An empty set of abrasive supply hoppers 38 is moved from its location on a respective set of blast pots 36 on a respective blast pot support platform 22, as explained towards the beginning of this detailed description, and set on an empty bogie 142 upstream of the master hopper 140. The empty set is rolled forwards on the bogie, under the master hopper 140, the shutter of which is temporarily opened successive times to fill each of the abrasive supply hoppers 38. Downstream of master hopper, a full set of supply hoppers 38 is crane-lifted off the respective bogie and back to a position on top of a set of blast pots 36 up on a platform 22. The empty bogie can be recirculated from its downstream position on the rails 144 to the upstream position, for receiving an empty set of abrasive supply hoppers. (Or, if only one bogie is in use on the rails 144, the empty bogie can simply be pushed along the rails from the downstream position to the upstream position.)

Preferred practices of the apparatus and method of the present invention make possible further significant improvements in environmental compliance during ship-hull cleaning, as follows:

a. By facilitating the positioning of blast pots and abrasive supply hoppers by drydock crane on multiple platforms on the drydock wing wall, clean abrasive material handling in support of abrasive blasting is performed more efficiently.

b. By providing the means of using recyclable steel or mineral abrasive and of magnetic pick up of used abrasive off the floor of the drydock and convenient conveyor abrasive disposal locations along the length of the drydock, much required abrasive clean-up labor is eliminated.

c. By conveying the used abrasive directly from the drydock disposal location to the abrasive recycling location, significant used abrasive material handling is eliminated.

d. By automated transfer of abrasive supply hoppers from their fill position under the abrasive classifier and storage hopper to a lift position under the drydock crane, significant clean abrasive material handling is eliminated.

e. By providing a complete dry loop for abrasive material handling through the phases of abrasive supply, abrasive blasting, used abrasive clean up, used abrasive transport to recycling, used abrasive recycling and recycled abrasive transport back to the abrasive supply point. Use of recyclable steel or mineral abrasive is made possible for ship abrasive blasting. This significantly reduces abrasive acquisition and disposal costs and reduces the quantity of used abrasive waste generated, by an order of magnitude.

It should now be apparent that the apparatus and method for performing external surface work on ship hulls as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A process for abrasive blast-cleaning a generally vertical external surface of a ship hull supported on a deck of a drydock, comprising:

(a) supplying dry abrasive grit from at least one supply hopper disposed at at least one elevated location through a respective hose to a respective work head controlled by a respective operator on a respective tower-supported elevatable work platform, each operator directing the respective work head towards the external surface of the ship hull as abrasive grit is propelled therefrom, thereby impacting and rebounding from said external surface together with removed debris and falling as spent abrasive mixed material;

(b) collecting the spent abrasive mixed material and subjecting the collected spent abrasive mixed material to classification into undersize dust, oversize trash and reuseable dry abrasive grit; and (c) refilling each said supply hopper with said reuseable dry abrasive grit.

2. The method of claim 1, wherein:

said dry abrasive grit is made of ferromagnetic material and said collecting step comprises sweeping up spent abrasive mixed material from the deck of the drydock using a magnetic collector.

3. The method of claim 1, wherein:

step (a) further includes forming a rainproof curtain-enclosed space around each said tower-supported elevatable work platform, against said ship-hull surface, so that the spent abrasive mixed material which falls and is collected remains dry.

4. The method of claim 3, wherein:

said at least one supply hopper comprises at least one set of at least three supply hoppers arranged side by side on a respective stacking frame, and there are at least three said tower-supported elevatable work platforms, arranged side by side along said external surface of said ship hull and all disposed within said curtain-enclosed space; and said subjecting of the collected spent abrasive mixed material is conducted at an abrasive recycling station; and cycling said set of supply hoppers, on said stacking frame, upon their becoming effectively empty as a result of conducting step (a), to said abrasive recycling station for said refilling with said reuseable dry abrasive grit, and cycling the thus-refilled set on said frame back to a respective said elevated location.

5. The method of claim 4, wherein:

said drydock has wing walls, and each said elevated location is provided on an upper end of a respective wing wall.

6. The method of claim 4, further comprising:

providing a catch pan under each said tower-supported elevatable work platform and extending forwardly therefrom into proximity with said external surface of the ship hull; and funneling spent abrasive mixed material collected by each said catch pan, to said abrasive recycling station.

7. The method of claim 6, wherein:

said dry abrasive grit is made of ferromagnetic material and said collecting step further comprises sweeping up spent abrasive mixed material from the deck of the drydock using a magnetic collector.

8. The method of claim 6, wherein:

in conducting step (a), the dry abrasive grit is supplied by each said supply hopper by gravity to a respective underlying blast pot, and by the respective blast pot by compressed air through the respective said hose; and each said work head is a nozzle out through which the dry abrasive grit is propelled by spraying entrained in a stream of thereby released compressed air.

9. The method of claim 6, wherein:

said abrasive recovery station is located on a barge moored adjacent an end of said drydock; and step (b) includes conveying the collected spent abrasive mixed material along said drydock on a succession of conveyors, to a classifier located at said abrasive recovery station.

10. Apparatus for abrasive blast-cleaning a generally vertical external surface of a ship hull supported on a deck of a drydock, comprising:

(a) means for supplying dry abrasive grit from at least one supply hopper disposed at at least one elevated location through a respective hose to a respective work head controlled by a respective operator on a respective tower-supported elevatable work platform, each operator directing the respective work head towards the external surface of the ship hull as abrasive grit is propelled therefrom, thereby impacting and rebounding from said external surface together with removed debris and falling as spent abrasive mixed material;

(b) means for collecting the spent abrasive mixed material and subjecting the collected spent abrasive mixed material to classification into undersize dust, oversize trash and reuseable dry abrasive grit; and (c) means for refilling each said supply hopper with said reuseable dry abrasive grit.

11. The apparatus of claim 10, further including:

means forming a rainproof curtain enclosed space around each said tower-supported elevatable work platform, against said ship-hull surface, so that the spent abrasive mixed material which falls and is collected remains dry.

12. The apparatus of claim 11, wherein:

said at least one supply hopper comprises at least one set of at least three supply hoppers arranged side by side on a respective stacking frame, and there are at least three said tower-supported elevatable work platforms, arranged side by side along said external surface of said ship hull and all disposed within said curtain-enclosed space;

an abrasive recycling station at which to conduct said classification;

means for cycling said set of supply hoppers on said stacking frame, upon their becoming empty as a result of said supplying dry abrasive grit, to said abrasive recycling station for said refilling with said reuseable dry abrasive grit, and cycling the thus-refilled set on said frame back to a respective said elevated location.

13. The apparatus of claim 12, further comprising:

a catch pan provided under each said tower-supported elevatable work platform and extending forwardly therefrom into proximity with said external surface of the ship hull; and means for funneling spent abrasive mixed material collected by each said catch pan, to said abrasive recycling station.

14. The apparatus of claim 13 arranged to be used in an instance in which the dry abrasive grit is made of ferromagnetic material, said means for collecting the spent abrasive mixed material includes means for sweeping up spent abrasive mixed material from the deck of the drydock using a magnetic collector.

15. The apparatus of claim 13, wherein:

said means for supplying further includes an underlying blast pot for each said supply hopper, whereby dry abrasive grit is supplied by each said supply hopper by gravity to a respective underlying blast pot, and by the respective blast pot by compressed air through the respective said hose; and each said work head is a nozzle out through which the dry abrasive grit is propelled by spraying entrained in a stream of thereby released compressed air.

16. The apparatus of claim 13, wherein:

said abrasive recovery station is located on a barge moored adjacent an end of said drydock; and said means for collecting includes means for conveying the collected spent abrasive mixed material along said drydock on a succession of conveyors, to a classifier located at said abrasive recovery station.

* * * * *